US006647686B2

(12) United States Patent
Dunn et al.

(10) Patent No.: US 6,647,686 B2
(45) Date of Patent: Nov. 18, 2003

(54) SYSTEM FOR CONSTRUCTING INSULATED CONCRETE STRUCTURES

(76) Inventors: Daniel D. Dunn, 919 W. 1220 North, Lehi, UT (US) 84043; David C. Dunn, 919 W. 1220 North, Lehi, UT (US) 84043; Daniel V. Sorensen, 861 E. 2180 North, Lehi, UT (US) 84043

( * ) Notice: Subject to any disclaimer, the term of this patent is extended or adjusted under 35 U.S.C. 154(b) by 152 days.

(21) Appl. No.: 09/803,205

(22) Filed: Mar. 9, 2001

(65) Prior Publication Data

US 2002/0124508 A1 Sep. 12, 2002

(51) Int. Cl.[7] ..... E04B 2/28

(52) U.S. Cl. ..... 52/426; 52/309.17; 52/592.6; 52/442

(58) Field of Search ..... 249/33, 40, 189, 249/190, 210; 52/71, 220.2, 309.12, 309.14, 309.17, 425, 426, 713, 591.2, 592.6, 105

(56) References Cited

U.S. PATENT DOCUMENTS 4,223,501 A * 9/1980 DeLozier ..... 52/309.11
4,229,920 A 10/1980 Lount (List continued on next page.)

*Primary Examiner*—Carl D. Friedman
*Assistant Examiner*—Jennifer I. Thissell

(57) ABSTRACT

A system for constructing insulated concrete structures comprising panels molded from a closed cell foam plastic, with a facing material attached to the outside surface of panels adding substantial strength to panels during material handling and construction, providing a substrate for finish materials and adding UV resistance to panel surfaces. Panels are placed horizontally in an opposing and parallel spaced-apart relationship. Vertical studs are embedded in panels extending the full height of the panels, each stud has a flange and groove connected with a web. Spreaders slide vertically into the grooves of studs in opposing panels creating a form with a cavity between panels. Each spreader has opposing flanges connected by horizontal members, horizontal members having multiple formations, thus when spreaders are stacked the formations compliment each other allowing wall reinforcing to be locked in any preferred location. A chase way is provided in panels to accommodate electrical wiring. Locations of studs and chase ways are shown by markings on the facing. Reinforcing clips provide additional means for securing wall reinforcing to maintain proper alignment. Panels are placed horizontally end to end in rows and stacked vertically, rows of panels being staggered from each other so panel ends in adjacent rows do not line up vertically. Spreaders are stacked vertically in such a manner as to engage studs half their height above and below horizontal joints between rows of panels. Hinged forms, corner forms and bearing ledge forms are also provided for versatility in constructing the above mentioned insulated concrete structures.

5 Claims, 17 Drawing Sheets

U.S. PATENT DOCUMENTS 4,439,967 A * 4/1984 Dielenberg ..... 52/309.12
4,604,843 A * 8/1986 Ott et al. ..... 52/426
4,698,947 A 10/1987 McKay
4,706,429 A 11/1987 Young
4,730,422 A 3/1988 Young
4,731,968 A 3/1988 Obino
4,866,891 A 9/1989 Young
4,884,382 A 12/1989 Horobin
5,014,480 A 5/1991 Guarriello et al.
5,102,710 A * 4/1992 Kaufman et al. ..... 428/71
5,107,648 A 4/1992 Roby
5,123,222 A 6/1992 Guarriello et al.
5,140,794 A 8/1992 Miller
5,390,459 A 2/1995 Mensen
5,465,542 A 11/1995 Terry
5,487,248 A 1/1996 Artzer
5,568,710 A 10/1996 Smith et al.
5,570,550 A 11/1996 Roby
5,570,552 A 11/1996 Nehring
5,596,855 A 1/1997 Batch
5,611,182 A 3/1997 Spude
5,625,989 A 5/1997 Brubaker et al.
5,649,401 A 7/1997 Harrington, Jr.
5,657,600 A 8/1997 Mensen
5,658,483 A 8/1997 Boeshart
5,664,382 A 9/1997 Melnick et al.
5,701,710 A 12/1997 Tremelling
5,704,180 A 1/1998 Boeck
5,709,060 A 1/1998 Vaughan et al.
5,735,093 A 4/1998 Grutsch
5,771,648 A 6/1998 Miller et al.
5,809,727 A 9/1998 Mensen
5,809,728 A 9/1998 Tremelling
5,845,449 A 12/1998 Vaughan et al.
5,852,907 A 12/1998 Tobin et al.
5,887,401 A 3/1999 Moore, Jr.
5,890,337 A 4/1999 Boeshart
5,924,247 A 7/1999 Van Horn et al.
5,930,958 A 8/1999 Stanley
5,987,830 A 11/1999 Worley
5,992,114 A 11/1999 Zelinsky et al.
6,070,380 A 6/2000 Meilleur
6,128,882 A * 10/2000 Jones ..... 52/665
6,134,861 A 10/2000 Spude
6,230,462 B1 5/2001 Beliveau
6,305,142 B1 * 10/2001 Brisson et al. ..... 52/742.14
6,318,040 B1 * 11/2001 Moore, Jr. ..... 52/426
6,378,260 B1 * 4/2002 Williamson et al. ..... 52/426
6,401,419 B1 * 6/2002 Beliveau ..... 52/592.6
6,418,686 B1 * 7/2002 Record ..... 52/309.15
6,438,918 B2 * 8/2002 Moore, Jr. et al. ..... 52/426

* cited by examiner

SYSTEM FOR CONSTRUCTING INSULATED CONCRETE STRUCTURES

BACKGROUND OF THE INVENTION

The present invention relates to construction using Insulating Concrete Forming Systems (ICFS), and more particularly to a new system for constructing insulated concrete structures.

Insulating Concrete Forming Systems (ICFS) which are currently known, act as forms for the construction of concrete walls, the end benefit is a wall which is already insulated and ready for the application of exterior and interior finish materials. The known ICFS currently in use comprise a pair of foam plastic panels connected by a plurality of ties or connectors. The panels are molded from expanded polystyrene (EPS) beads providing low density foam plastic panels which are used as a form to contain the concrete during placement. The EPS beads are expanded with high pressure steam, in molds that are confined by a large press.

An example of Known art is U.S. Pat. No. 5,896,714 issued to Cymbala et al. on Apr. 27, 1999 comprises pairs of panels molded from EPS and connected by ties. The ties have opposed vertical flanges with web portions extending between. In one embodiment the flanges of the ties are molded within the panels, the web members extending between panels. In another embodiment the panels are formed with "T"-shaped slots amenable to accept the flanges of the ties.

Another example of known art is U.S. Pat. No. 6,170,220 issued to Moore, Jr. on Jan. 9, 2001 comprising opposing panels molded from EPS and using molded-in web members. The web members have attachment points that extend past the inside face of the panels, the connecters extend between and engage the attachment points of opposing panels.

Known art systems are limited in many respects due to the materials used, the manufacturing process and the configuration of the ties, webs and connectors. The EPS foam doesn't adhere to the ties and webs when using molded-in configurations causing a weak point in the panels at each tie or web location. In the slide-in configurations the molded slots penetrate deeply into the panels also creating a weakness at each penetration. There are no ties or webs located at the panel ends allowing the vertical joints to bulge or blowout during concrete placement. The panels are manufactured in small units approximately 12 inches to 16 inches in height and 36 inches to 48 inches in length, the size being limited by the strength of the low density EPS and the prohibitive cost of larger molds and more expensive machinery to contain the molds during the high pressure steam expansion process. EPS has a relatively low R-value per inch and the poor structural characteristic make it prone to damage during material handling and construction.

The tie configuration disclosed in Cymbala is typical of many of the known art systems, the webs of the ties comprising closely spaced members leaving little open space through the webs, in effect, perforating the concrete at each tie location. In Moore, Jr. there are numerous connectors required between the panels to hold the pressure of the poured concrete. These restrictive configurations, and the close spacing of the ties, webs and connectors, create a structural weakness in the wall caused by the number of penetrations through the concrete, in addition they inhibit the natural flow of the concrete during placement increasing the difficulty of pouring the walls and causing honey comb in the concrete. The inherent weakness of the EPS makes it very difficult to vibrate the walls to increase the concrete flow and reduce the honey comb without causing the forms to bulge or blowout. In the molded-in tie and web configurations the inability of the EPS to bond to the flanges of the ties and web members allows the panels to split along the flanges under the pressure of the concrete during placement, causing the walls to bulge and blowout. In Moore, Jr. the large number of connectors that must be installed is time-consuming and the labor required is costly.

The use of EPS foam as a form material, the use of small unit sizes and the restrictive tie, web and connector configurations create difficulties that must be overcome. When using small unit sizes there are more units to set increasing the labor required to erect a wall. There are more horizontal and vertical joints increasing the possibility of blowouts during concrete placement and a greater amount of bracing is required to straighten and stabilize the walls. Great care must be taken while placing the concrete to prevent blowouts, the concrete must be placed slowly and in short lifts. Also when EPS foam is exposed to sunlight for any period of time it deteriorates causing a powder to form on the surface of the panels, thus when using finish materials which require a strong bond to the substrate special treatment is required to remove the deterioration. A large amount of labor is required to prepare the numerous horizontal and vertical joints before the application of finish materials. Another downfall of the known art systems is the lack of an easy method for securing wall reinforcing, manual tying of the wall reinforcing is time-consuming and the extra labor required is costly.

BRIEF SUMMARY OF THE INVENTION

The primary object of this invention is to provide a system for constructing Insulated Concrete Structures, allowing for virtually unlimited sizes, shapes and thickness of forms and also custom form configurations.

Another object of this invention is to provide a means for increased strength and durability of forms allowing for larger sizes.

Another object of this invention is to provide an improved form many times larger than other systems.

Another object of this invention is to provide an improved larger form thereby reducing the number of horizontal and vertical joints in a wall requiring less preparation work for interior and exterior finish materials.

Another object of this invention is to provide an improved larger form creating a stronger wall during erection and concrete placement.

Another object of this invention is to provide an improved larger form requiring less time to install, less bracing material and labor, allowing for substantial cost savings.

Yet another object of this invention is to provide a means for attaching a facing to forms, allowing direct application of exterior and interior finish materials thereby reducing the cost of finishing walls.

Yet another object of this invention is to provide a means for attaching a facing to forms, providing UV protection before and during construction.

Yet another object of this invention is to provide for attaching a facing to forms, allowing the embedded studs and chase ways to be located by markings on the facing.

Still yet another object of this invention is to provide embedded studs that extend the full height of forms providing greater strength of forms and ease of fastening interior and exterior finish materials.

Still yet another object of this invention is to provide a means for a variable, horizontal spacing between embedded studs, adding additional strength for greater lift heights during concrete placement and casting of thick walls, also for special user requirements.

A further object of this invention is to provide slide-in spreaders providing ease of installation and allowing for more compact shipping of forms.

A further object of this invention is to provide slide-in spreaders allowing a large variety of poured wall thicknesses.

A further object of this invention is to provide a means for spreaders to lap the horizontal joints between vertically stacked rows of forms by sliding into the grooves of the embedded studs in adjacent panels half their height above and below the joint, creating greater strength and stability during construction and concrete placement and forcing the wall to act as one unit from bottom to top.

A further object of this invention is to provide slide-in spreaders with multiple formations that compliment each other securing wall reinforcing in place there by reducing the amount of manual labor required to fasten reinforcing and maintaining alignment of reinforcing during concrete placement.

A further object of this invention is to provide slide-in spreaders with multiple formations that allows wall reinforcing to be placed in any location required by professional engineers.

A further object of this invention is to provide slide-in spreaders with minimal obstructions in the wall, allowing for the natural flow of concrete in the cavity during concrete placement, something unavailable in other systems.

Yet a further object of this invention is to provide slide-in spreaders and embedded studs enabling the forms to be cut and utilized at any desired height.

Yet a further object of this invention is to provide for slide-in spreaders and embedded stud installation at any cut vertical joint enabling the forms to be cut to any length, eliminating the need for additional bracing to prevent blow-outs during concrete placement.

Yet another object of this invention is to provide reinforcing clips as an additional means for securing wall reinforcing to maintain proper alignment and eliminate most manual tying of reinforcing.

Another object of this invention is to provide a chase way for electrical wiring.

Still yet another object of this invention is to provide hinged forms and corner forms allowing the formation of unlimited angles and tee walls.

Still yet another object of this invention is to provide bearing ledge forms for use as a ledge for brick, rock and other veneers and are useful for many other applications.

Other objects and advantages of the present invention will become apparent from the following descriptions, taken in connection with the accompanying drawings, wherein, by way of illustration and example, an embodiment of the present invention is disclosed.

The inherent problems of the known art are overcome by the present invention, which provides a system for constructing insulated concrete structures comprising large form panels molded from a closed cell foam plastic having inside and outside surfaces, top, bottom and end edges. Each panel has a facing attached to the outside surface, embedded vertical studs which extend the full height of the panel and a chase way to accommodate electrical wiring. Each panel has a tongue and a groove, the embedded studs extend down through the groove and the tongue having slots that correspond with the spacing of the studs, when the panels are stacked the studs slide into the slots in the tongue of the panel below aligning studs of adjacent panels vertically. The closed cell foam plastic is easily molded and has great strength and adhesive capabilities, allowing the panels to be cast in virtually any size and permanently adheres to the studs and facing creating an integral unit. The facing material provides a substrate for finish materials which substantially reduces the cost of finishing the wall, something which is unavailable in other systems. The facing material also adds substantial strength to the panels, provides a UV resistant surface on the panels and is marked for visually locating the embedded studs and electrical chase ways. The studs embed in the panels and bond with the foam plastic adding great strength to the forms. The studs accommodate slide-in spreaders to interconnect the form panels and provide a continuous means for attaching finish materials. The panels are placed in an opposing and parallel, spaced-apart, relationship and connected by a plurality of spreaders at each stud location that slide into the studs and extend between the opposing panels thereby creating a form with a cavity between the inside surfaces of the panels. The spreaders comprise opposing flanges oriented in an opposing parallel relationship, being connected by horizontal members, each member having multiple formations to accommodate wall reinforcing. The open design of the spreaders allows the concrete to flow naturally through the wall resulting in easier placement of the concrete and a much stronger wall than the known art. There are different widths of spreaders allowing the casting of a variety of different wall thicknesses.

In another embodiment of the invention a hinged form is provided, comprising at least one horizontal or vertical hinge embedded in at least one of the opposing form panels. The hinged forms can be used to form corners of any angle, allows tee walls to be formed easily and can also be used to form curved walls.

Another embodiment of the invention provides a corner form comprising opposing form panels being molded into inside and outside corner panels. Precast corner forms allow corners to be formed easily with little bracing.

A further embodiment provides a bearing ledge form comprising opposing form panels, one panel being molded with a haunch which provides a ledge for the support of brick, rock and other veneers and is useful for many other applications. The bearing ledge forms utilize specialized bearing ledge connectors which allow the bearing ledge to be installed at any location in a wall.

Multiple form panels are placed end to end in horizontal rows and stacked vertically. The panels may be staggered from each other so that ends of opposing panels are offset and end joints between adjacent rows of stacked panels do not line up vertically. There is a plurality of spreaders at each stud location, the spreaders being "full height spreaders," substantially less in height than the vertical height of the panels, and "half height spreaders," half the height of the full height spreaders. Spreaders are stacked vertically starting with a half height spreader with full height spreaders thereafter, so that at the top of each row of panels there is a full height spreader that slides into the studs in the row below half its height and into the studs in the row above the remaining half of its height, thereby stiffening the horizontal joint between rows of forms and forcing the walls to act as one unit from bottom to top. When the spreaders are stacked, the formations in the top and bottom horizontal members compliment the formations in adjacent spreaders allowing horizontal wall reinforcing to be locked in any preferred location. A reinforcing clip is provided as a means for securing vertical wall reinforcing or any horizontal reinforcing that is located at intermediate horizontal members of spreaders eliminating most manual tying of the wall reinforcing.

The large unlimited form sizes, the facing, the stud and spreader interface and the ability to lap the spreaders over the horizontal joints between rows of panels provides many benefits. The large forms require less time to place than prior art systems and the number of vertical and horizontal joints are reduced. The forms may be shipped as more compact units and assembled on site reducing the cost of shipping. The facing protects the forms from UV deterioration, from being damaged during shipment and construction and allows finish materials to be applied directly to the facing, greatly reducing the cost of finishing the walls. Lapping the spreaders over the horizontal joints straightens, strengthens and stabilizes the walls during construction and concrete placement by forcing the walls to act as one unit from bottom to top, requiring very little bracing during construction and concrete placement. It can be seen that the present invention provides many useful benefits that the known art cannot.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

Figure 1A:
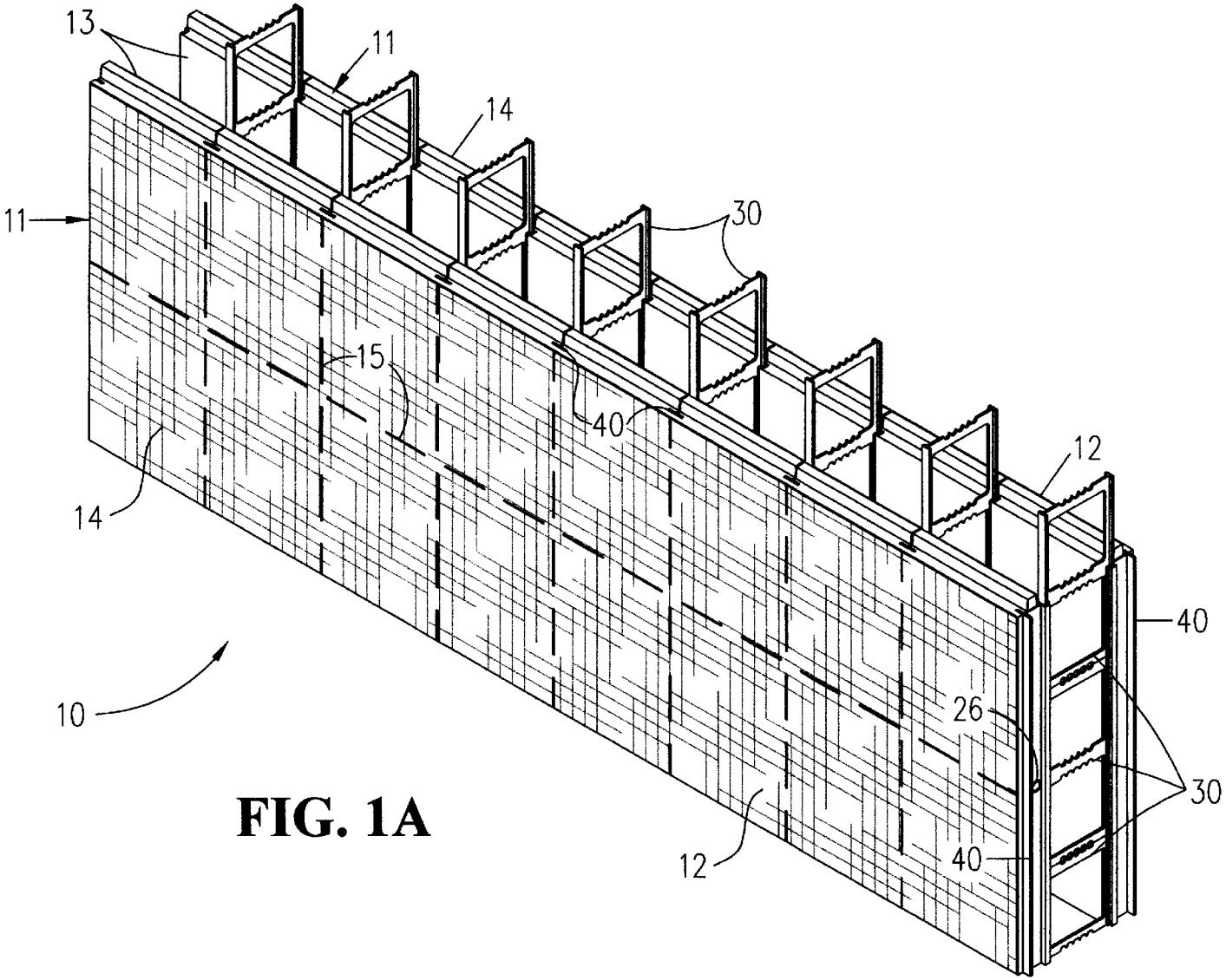
FIG. 1*a* is a perspective view of a form according to the present invention.
Figure 1B:
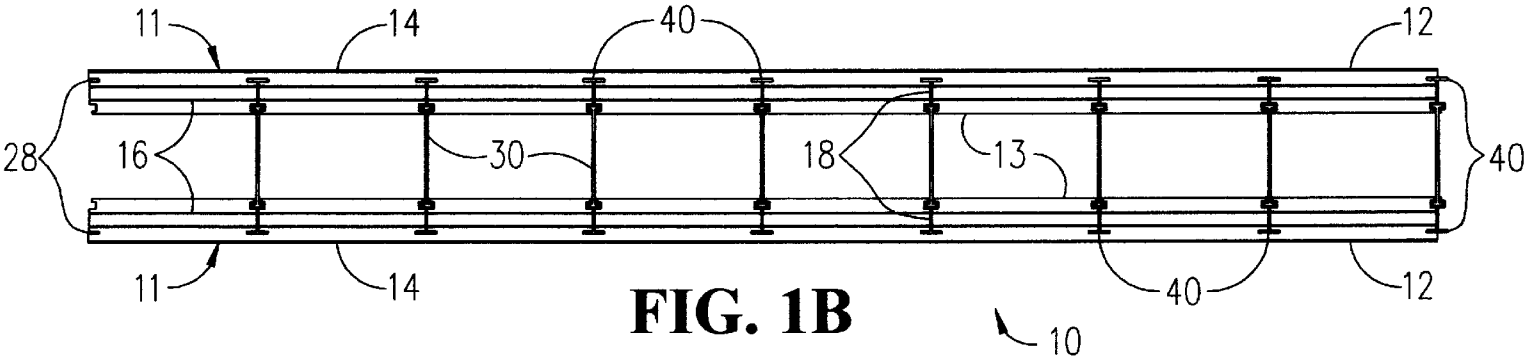
FIG. 1*b* is a top view of the form of FIG. 1*a*.
Figure 1C:
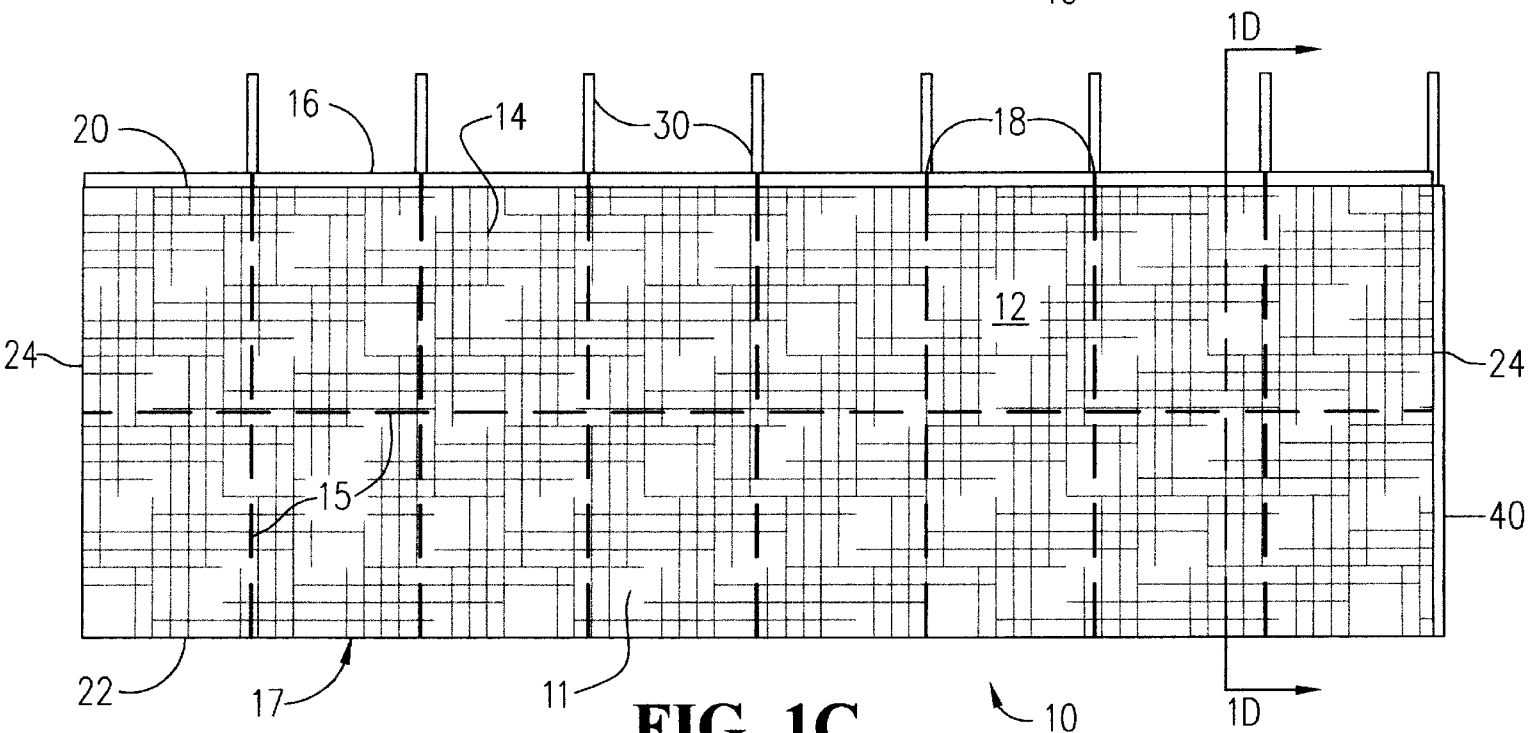
FIG. 1*c* is a side view of the form of FIG. 1*a*.
Figure 1D:
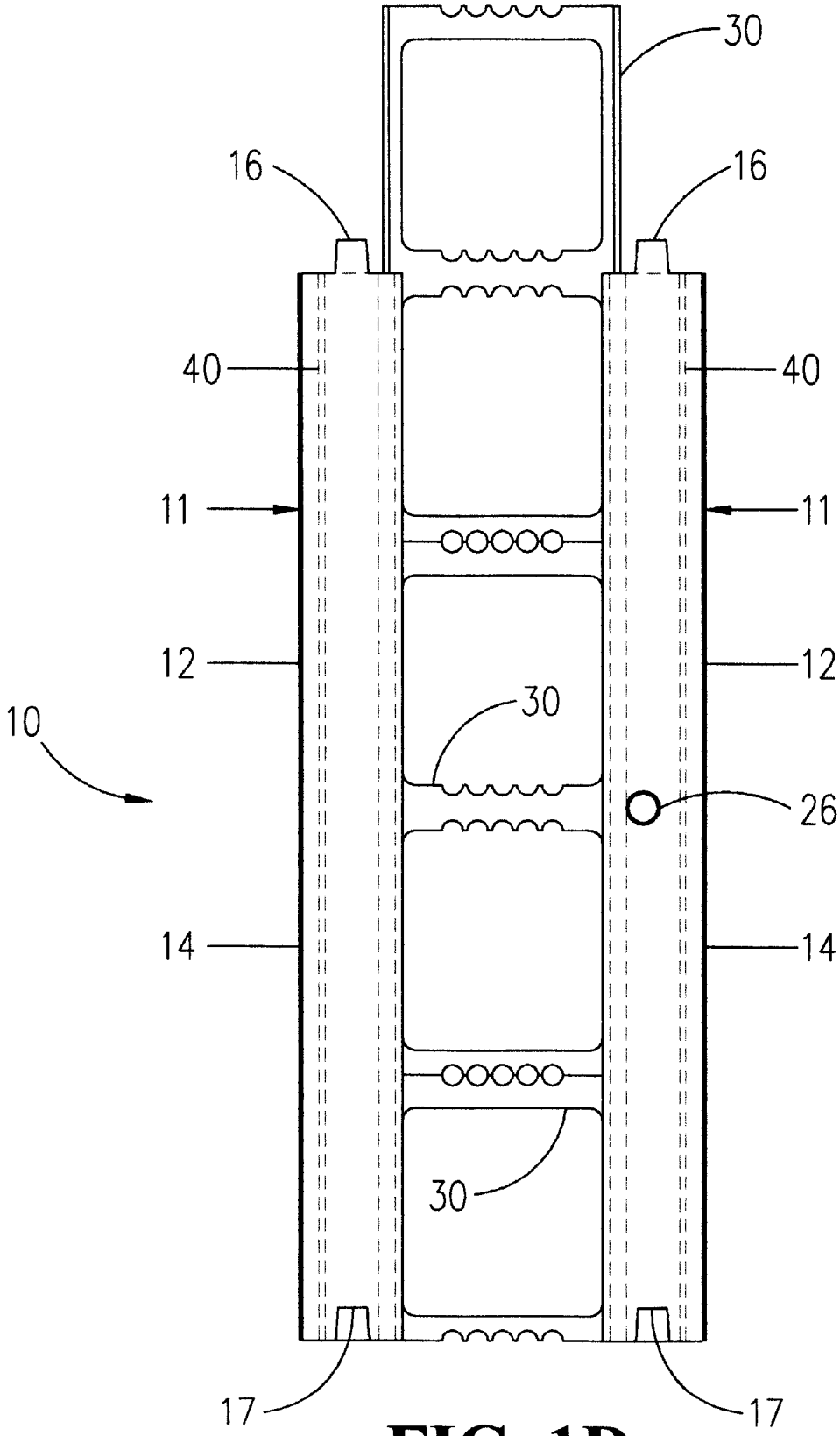
FIG. 1*d* is a cross-section view of the form of FIG. 1*a,* taken along line 1D—1D as shown in FIG. 1*c*.

Detailed descriptions of the invention are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Turning now to the drawings, there is shown in FIGS. 1*a* through 11 a forming system for constructing insulated concrete structures. A first embodiment of the present invention a form unit 10, as shown in FIGS. 1*a* through 1*d* comprises panels 11 placed in an opposing and parallel relationship, with a facing material 14 attached to the outside surface 12 of each panel 11, studs 40 are embedded in each panel and a chase way 26 is provided to accommodate electrical wiring. Spreaders 30 are located at each stud 40, sliding into and extending between the studs 40 in opposing panels 11 thereby creating a form with a cavity between the panels 11. The cavity is filled with fluid concrete to create a structure. The structural design of the concrete structures is based on the Uniform Building Code concrete wall design and other accepted building codes for concrete structures.

The panels 11 are molded from a closed cell foam plastic, having inside 13 and outside surfaces 12, top edges 20, bottom edges 22 and end edges 24. A means of interlocking the panels is provided comprising a tongue 16 that extends from and is parallel to the top edge 20 of each panel 11, and a complementary groove 17 recessed into and parallel to the bottom edge 22 of each panel 11. The embedded studs 40 extend through the groove 17 in each panel 11 and the tongue 16 has slots 18 that correspond with the studs 40 so that when the panels 11 are stacked the studs 40 engage the slots 18 in the tongue 16 of the row below, aligning studs 40 of adjacent panels 11 vertically. The interface of the panel ends 24 comprises a stud 40 halfway into and protruding halfway from the end 24 of a first panel 11, and a complimentary slot 28 in the end 24 of a second panel 11. Additionally, the panels 11 may be cut anywhere along their length and slotted 28 to accept a stud 40. When the panels are placed end 24 to end 24, they interlock and spreaders 30 are installed to connect the opposing panels 11. Thus the present invention discloses a method of utilizing studs 40 and spreaders 30 at the vertical joints between panels 11 to prevent bulging and blow outs, something the known art does not.

The closed cell foam plastic is preferably a plural component polyurethane consisting of an isocyanate A component and a polyol B component, which when combined react to create an expansive foam which is dispensed into molds to form the panels 11. It is preferable that the polyurethane is classified by the Uniform Building Code as Class 1 fire-rated per ASTM-E-84-77a. The polyurethane foam has other advantageous properties such as a high insulation value per inch, great structural strength, low water absorption, a high impedance to sound transmission and excellent adhesive capabilities. The panels 11 can be molded in virtually unlimited sizes. Preferred sizes for residential, commercial and industrial construction are 8 feet and 16 feet long with a height of 2 feet 8 inches and 16 feet long with a height of 4 feet.

Because of the adhesive properties of the foam plastic the facing 14 material is bonded to the outside surface 12 of the panels 11 and the studs 40 are permanently embedded in the panels 11 during the molding process, creating a strong integral unit, as a result the embedded studs 40 act as stiffeners which strengthen and reinforce the foam plastic. The combination of the facing 14, studs 40 and foam plastic adds great strength to the panels 11. It is shown that the panels 11 of the present invention have much greater strength than the known art, the foam plastic material is stronger and when it adheres to the panel components the form units have even greater strength during material handling, construction and concrete placement.

The facing 14 provides a substrate for finish materials which substantially reduces the cost of finishing the walls, especially when using stucco and elastomeric coatings, which can be applied directly to the facing 14. The facing 14 also provides a UV resistant surface on the panels 11 which allows the finish materials to be applied with no special preparation and is also marked for visually locating the embedded studs and chase ways. The facing 14 is preferably a fire rated, UV resistant flexible fiberglass material.

A chase way 26 for electrical will be provided in some panels 11 so that when a wall is erected the inside face of the wall will have a chase way 26 at 16 inches above the floor and another at 48 inches above the floor to accommodate plugs and switches. The chase way 26 is preferably a conduit that is embedded between and parallel to the inside surface 13 and outside surface 12 of the panels 11.

Having reference to FIGS. 2*a* through 2*b* and FIGS. 3*a* through 3*b* the spreaders 30 and studs 40 are preferably extruded from plastic such as Acrylonitrile Butadiene Styrene (ABS), High Density Polyethylene (HDPE) or Polypropylene (PP), and are then punched or routed to obtain the finish parts.

Figure 2A:
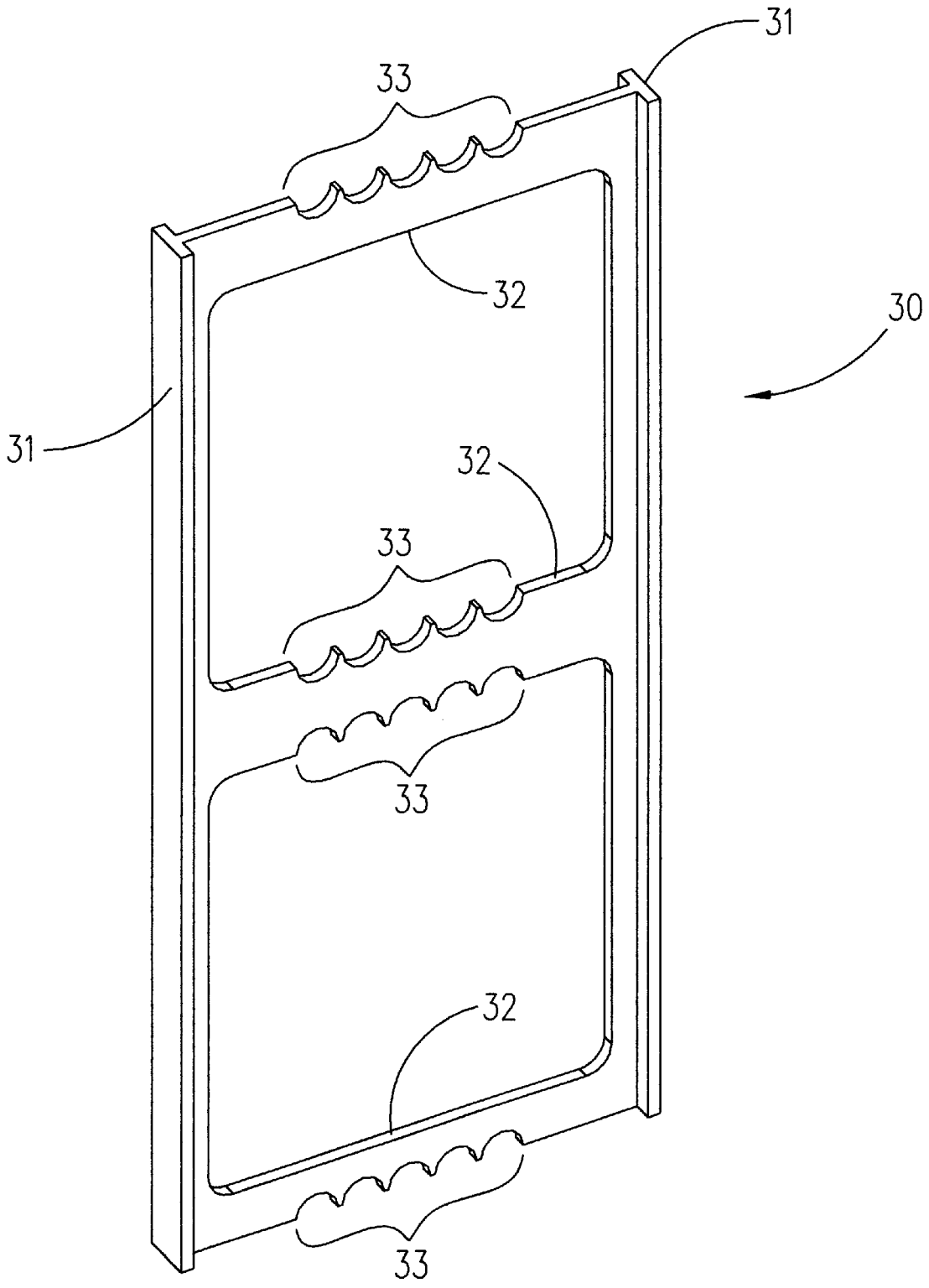
FIG. 2*a* is a perspective view of a spreader according to the present invention.
Figure 2B:
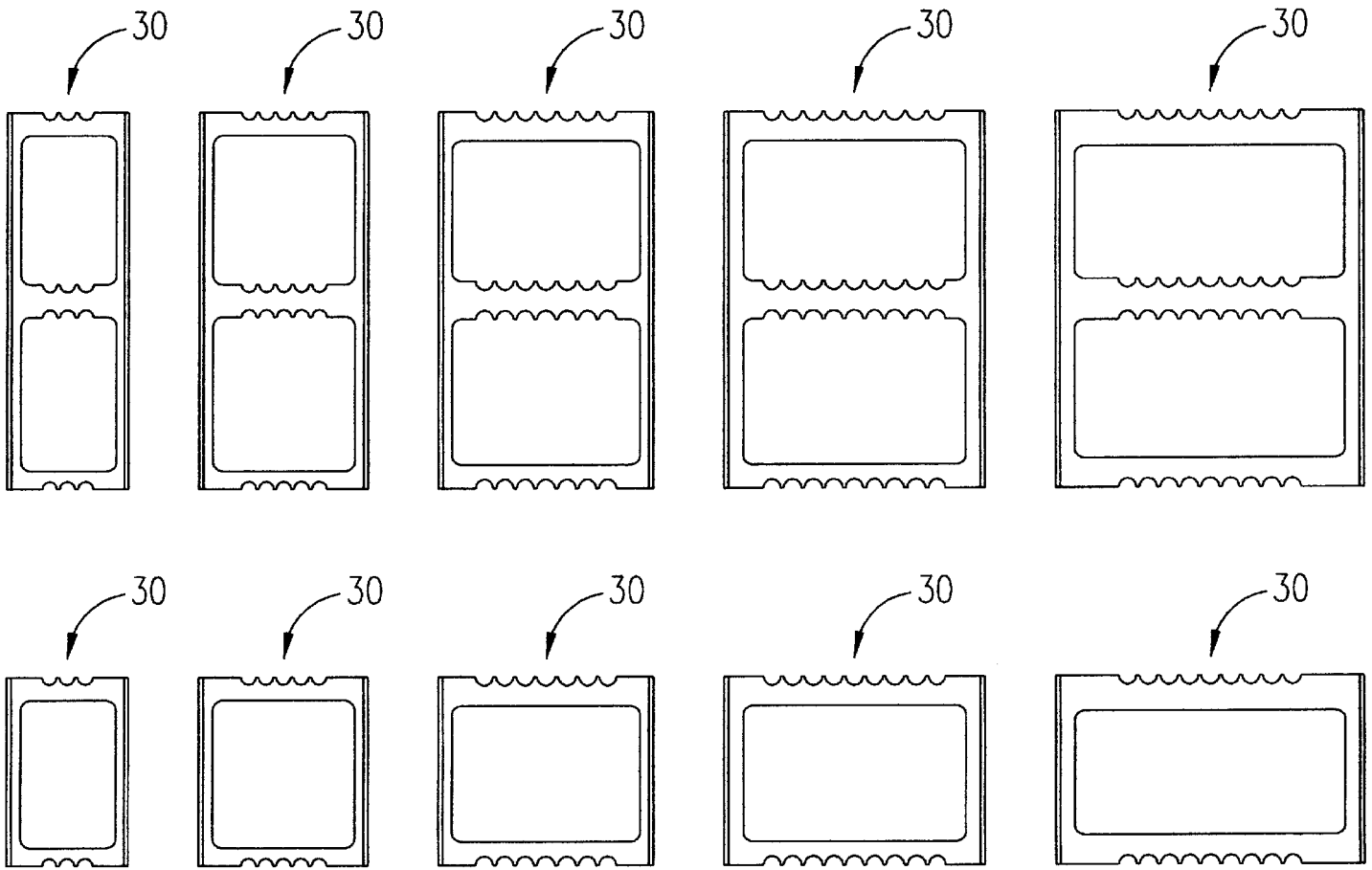
FIG. 2*b* is a side view showing different sizes of the spreader of FIG. 2*a*.

The spreaders 30 as shown in FIG. 2*a,* comprise opposing flanges 31 connected by horizontal members 32, the flanges 31 slide into the grooves of the studs 40 which will be discussed in further detail later. Preferably there are "full height spreaders" and "half height spreaders" as disclosed in a further embodiment which will be discussed later. Each horizontal member 32 has multiple formations 33 to accommodate wall reinforcing. The number of horizontal members 32 will vary depending on the thickness of the concrete core, typically the full height spreaders will have three horizontal members 32 and the half height spreaders will have two horizontal members 32. The formations 33 in the horizontal members 32 of both spreader configurations will occur in the top of the topmost member and in the bottom of the bottommost member. The intermediate horizontal members 32 will preferably have formations 33 on both sides of the member. The open design of the spreaders 30 allows the concrete to flow naturally through the wall resulting in easier placement of the concrete and a much stronger wall than the known art. The spreaders 30 vary in width (FIG. 2*b*) to facilitate the casting of different concrete wall thicknesses, the walls are typically cast with concrete cores from 4 inches to 12 inches thick, the spreader 30 size increases in 1 inch increments to facilitate these different wall thicknesses. The slide-in spreader 30 configuration allows the panels to be shipped in compact units which reduces shipping costs. The slide-in spreaders 30 are quickly and easily installed saving time and money erecting the structures.

Figure 3A:
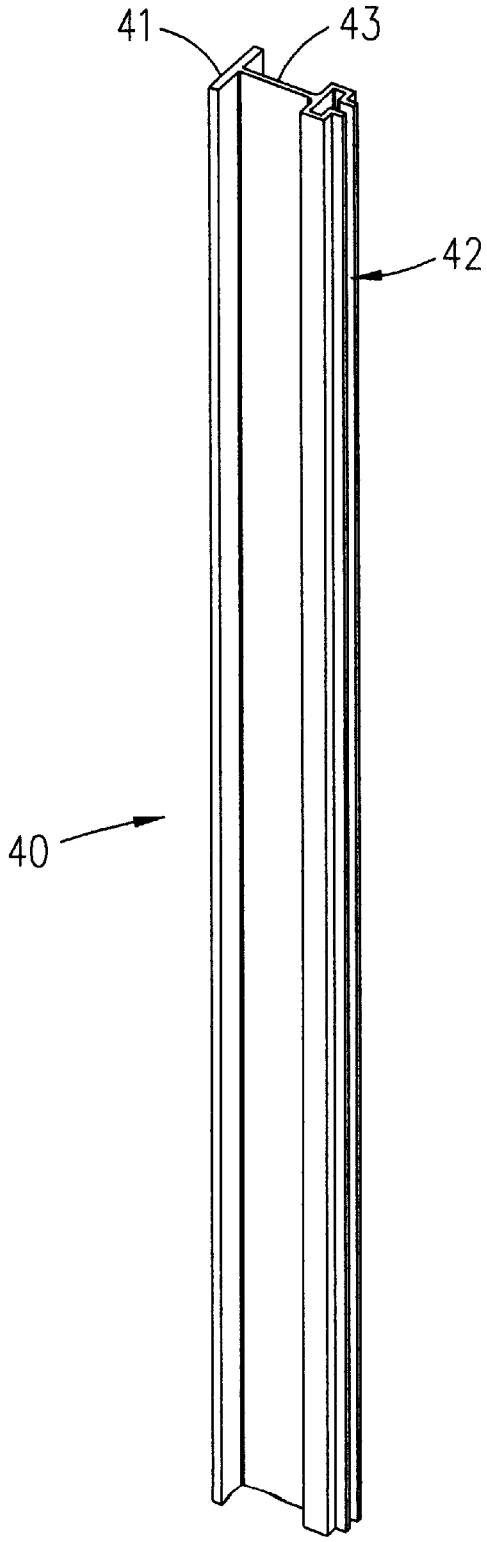
FIG. 3*a* is a perspective view of a stud according to the present invention.
Figure 3B:
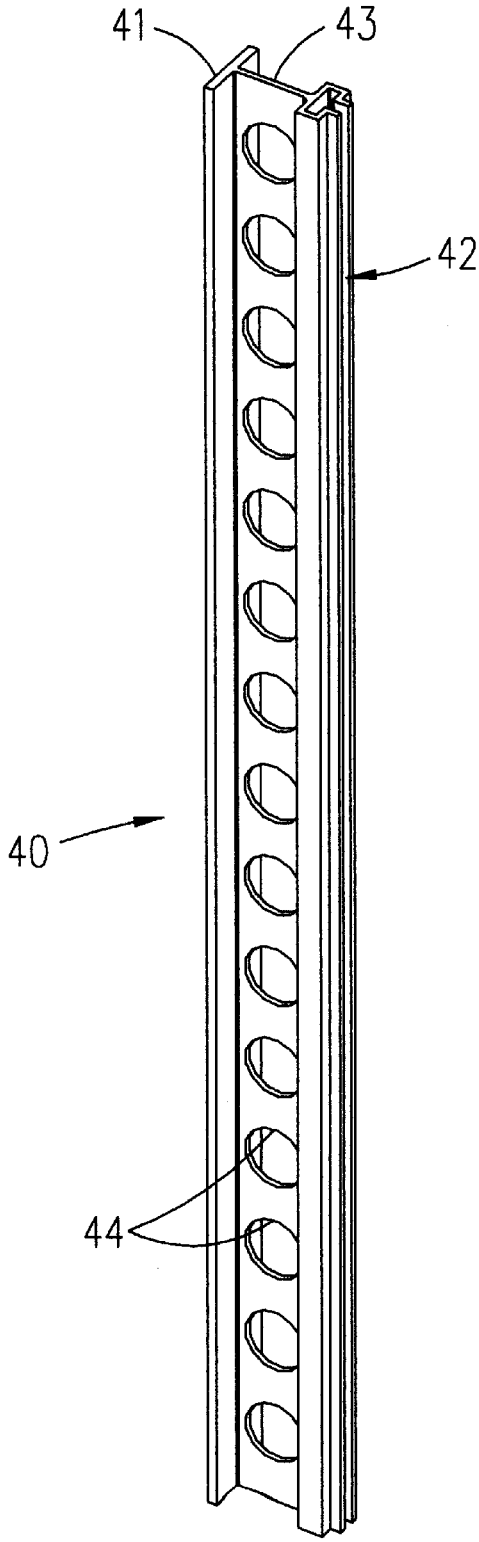
FIG. 3*b* is a perspective view of an embodiment of the invention showing a stud with apertures along its length.

The studs 40 as shown in FIG. 3*a,* comprise a flange 41 for fastening finish materials and a groove 42 for sliding spreaders 30 into, with a web member 43 extending there between to interconnect the flange 41 and the groove 42. There are at least two studs 40 in each panel 11 that extend vertically the full height of the panels 11, providing a means of interconnecting opposing panels 11 and providing continuous means of attaching finish materials. The spacing of the studs 40 will vary from 8 inches to 16 inches depending on the thickness of the concrete core. The web 43 comprises a vertical member which is oriented transversely to the flange 41 and the groove 42. In a second embodiment of the stud 40 (FIG. 3*b*) the web 43 has a plurality of apertures 44 along its length to enhance the bond of the foam plastic from one side of the web 43 to the other.

Figure 4A:
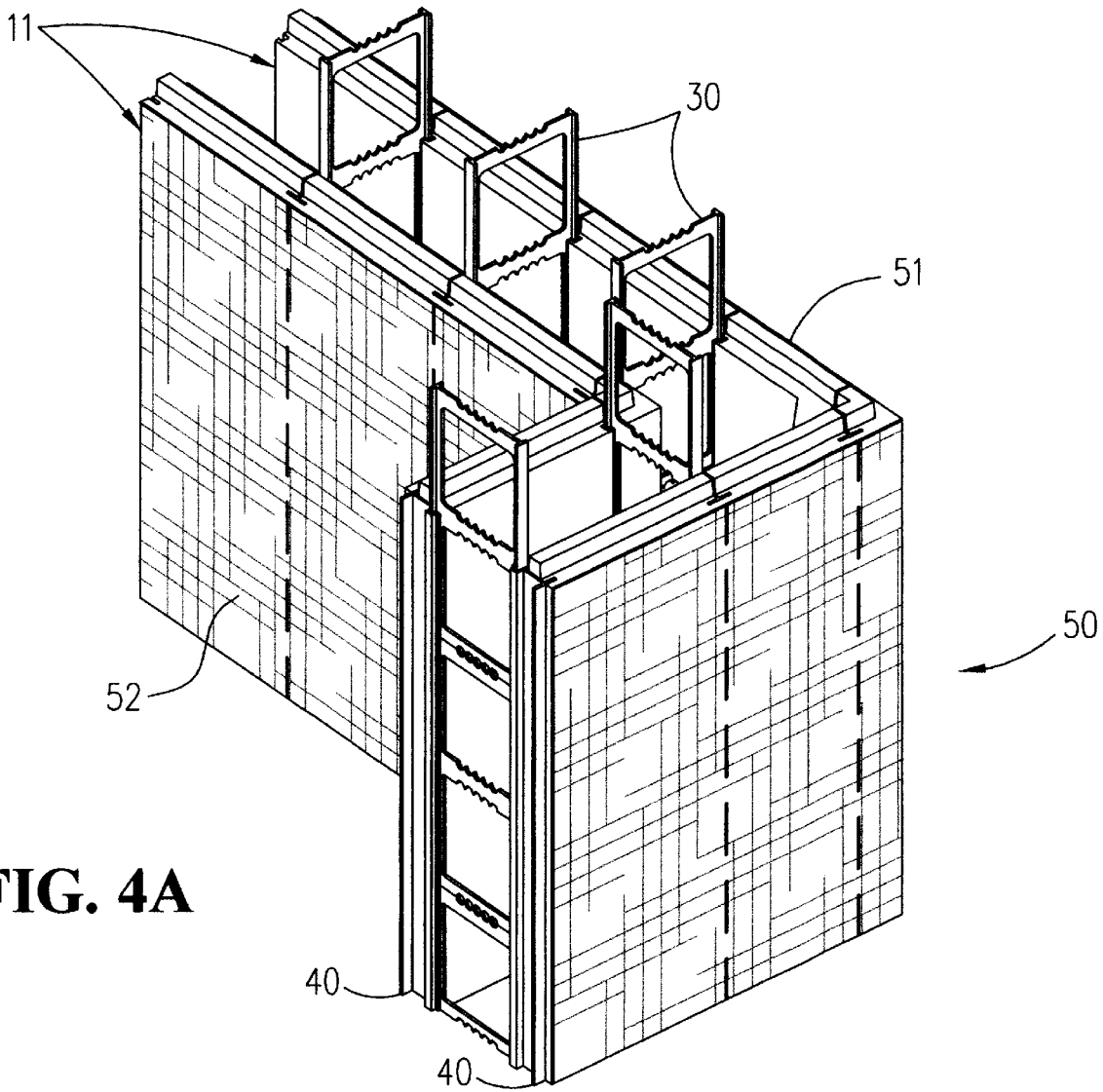
FIG. 4*a* is a perspective view of a corner form according to the present invention.
Figure 4B:
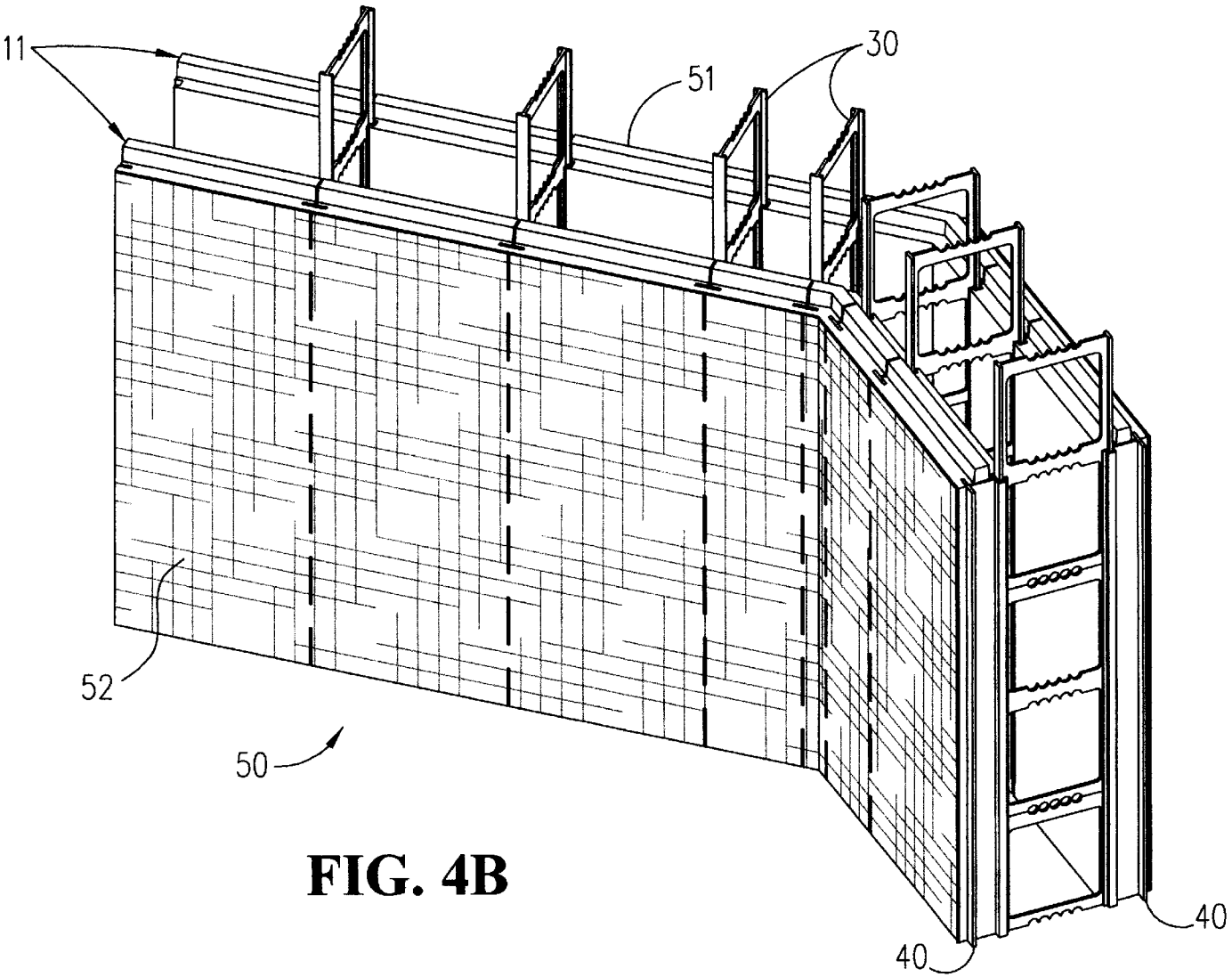
FIG. 4*b* is a perspective view of a corner form molded at an oblique angle according to the present invention.

Another embodiment of the present invention FIGS. 4*a* through 4*b,* provides corner forms 50 comprising opposing panels 11 being molded into inside corner panels 52 and outside corner panels 51. The corner forms 50 can be molded at varies angles such as 90° corners and 45° corners, pre-molded corner forms 50 allow building corners to be erected quickly with little bracing.

Figure 5:
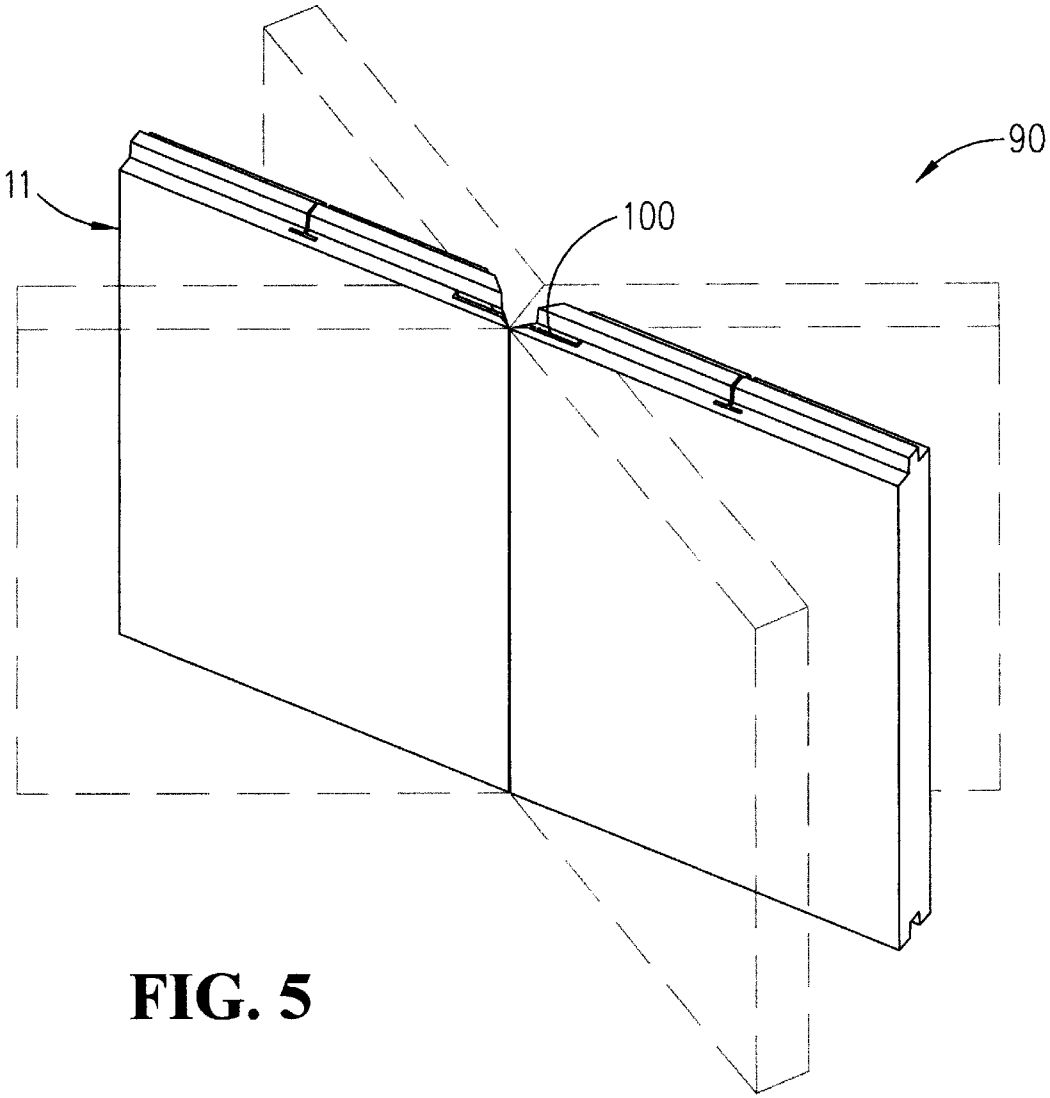
FIG. 5 is a perspective view of a hinged form panel according to the present invention.
Figure 6:
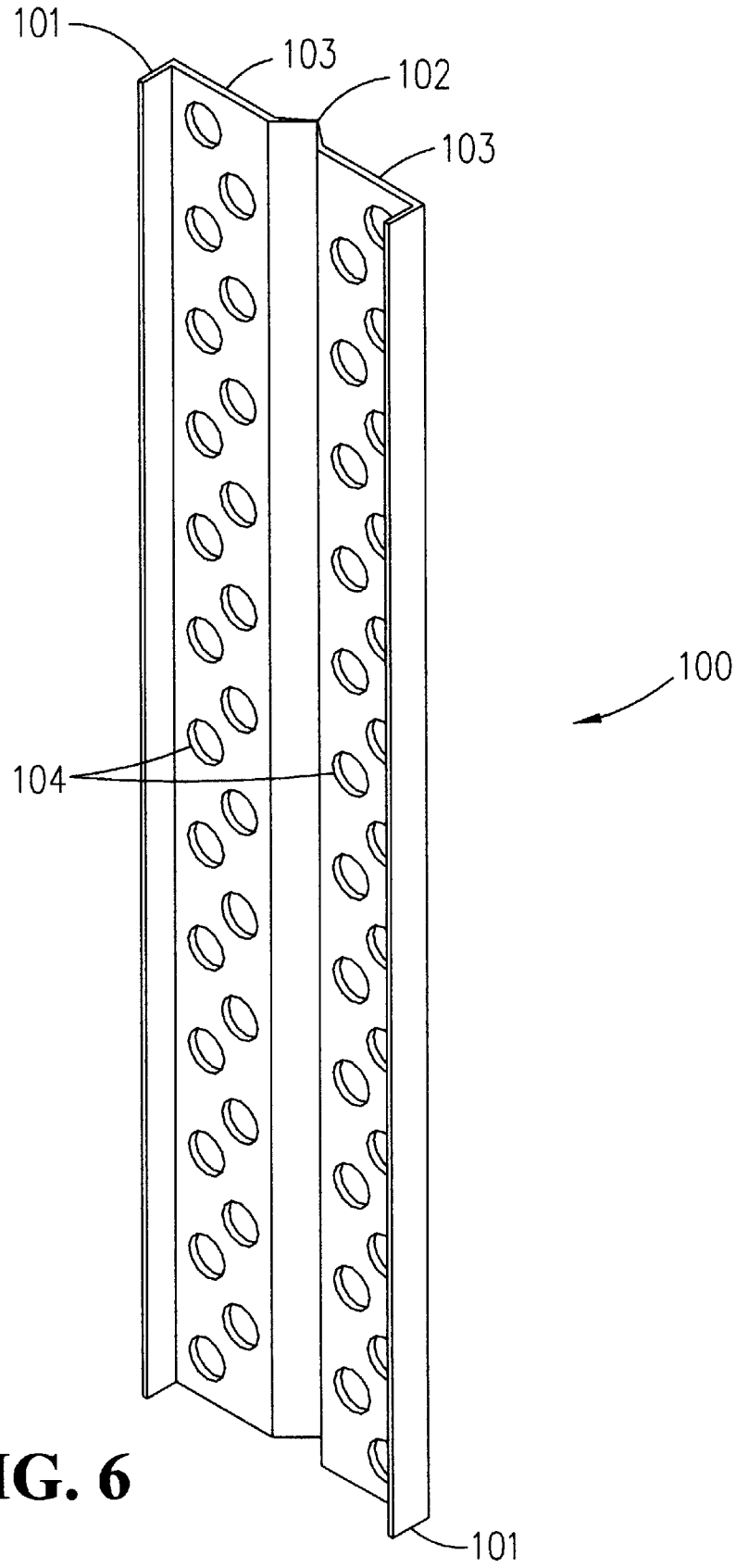
FIG. 6 is a perspective view of a hinge member according to the present invention
Figure 7A:
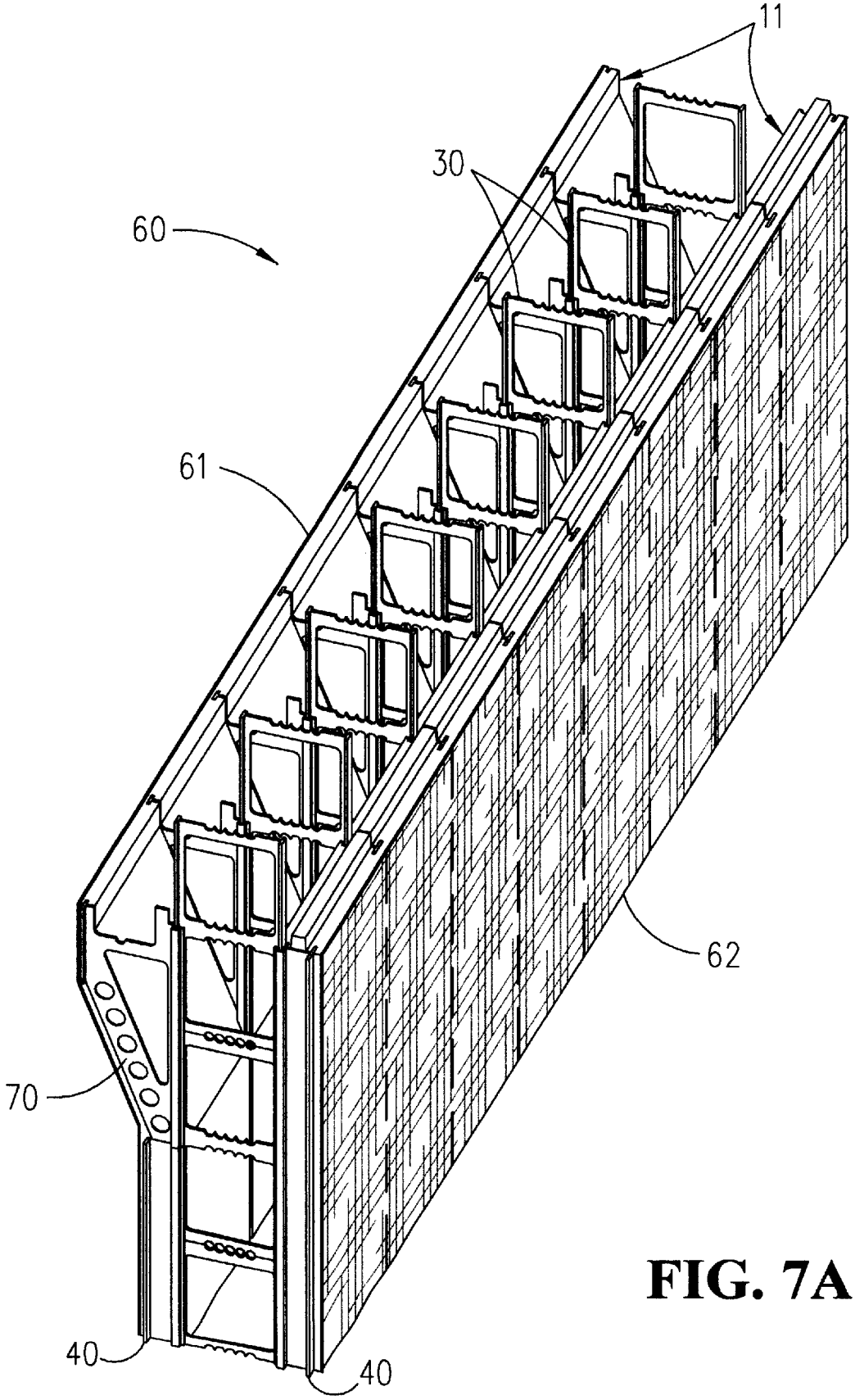
FIG. 7*a* is a perspective view of a bearing ledge form according to the present invention.
Figure 7B:
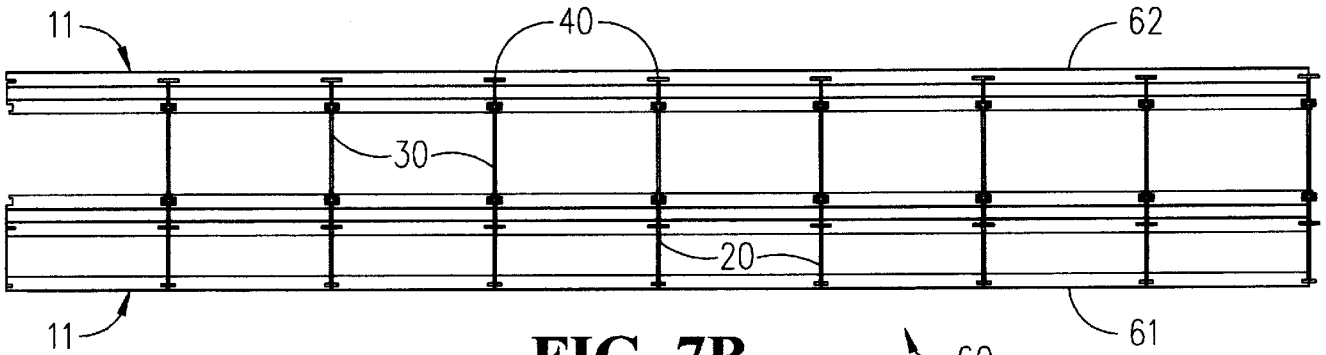
FIG. 7*b* is a top view of the bearing ledge form of FIG. 7*a*.
Figure 7C:
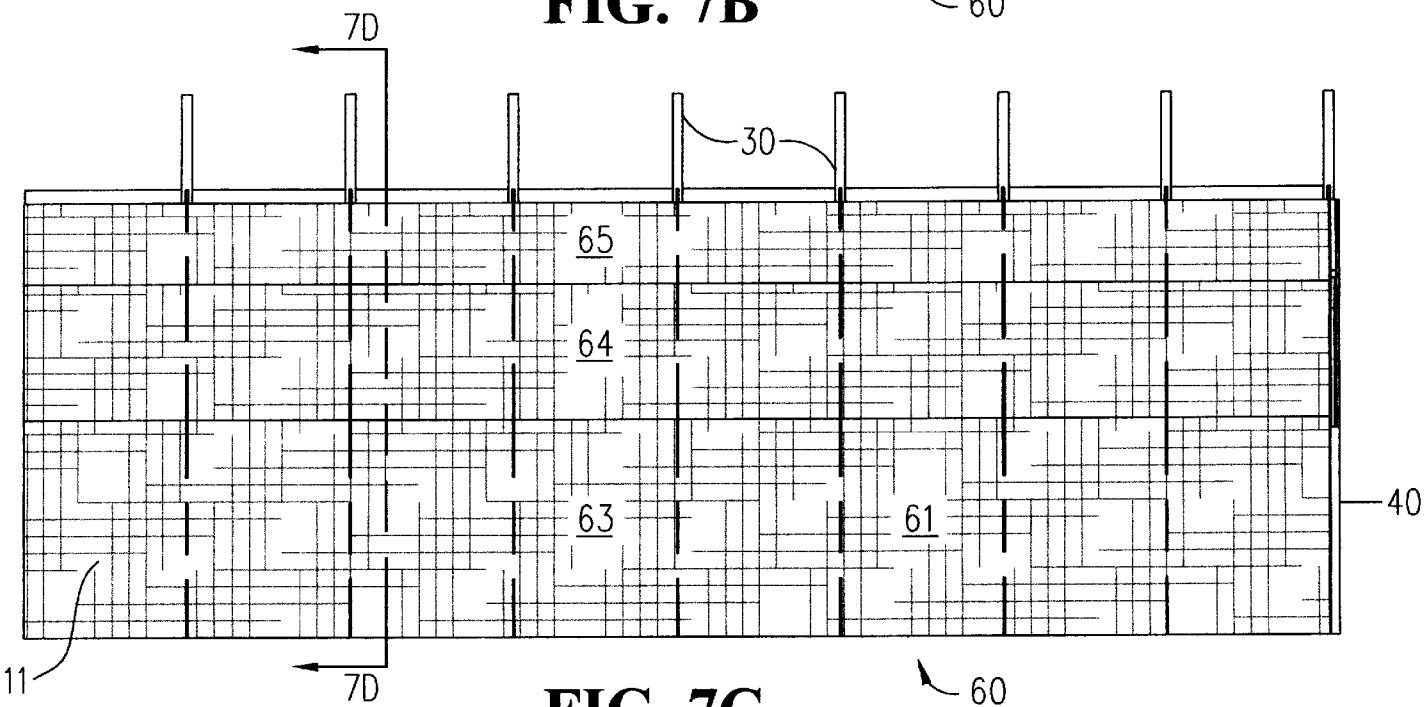
FIG. 7*c* is a side view of the bearing ledge form of FIG. 7*a*.
Figure 7D:
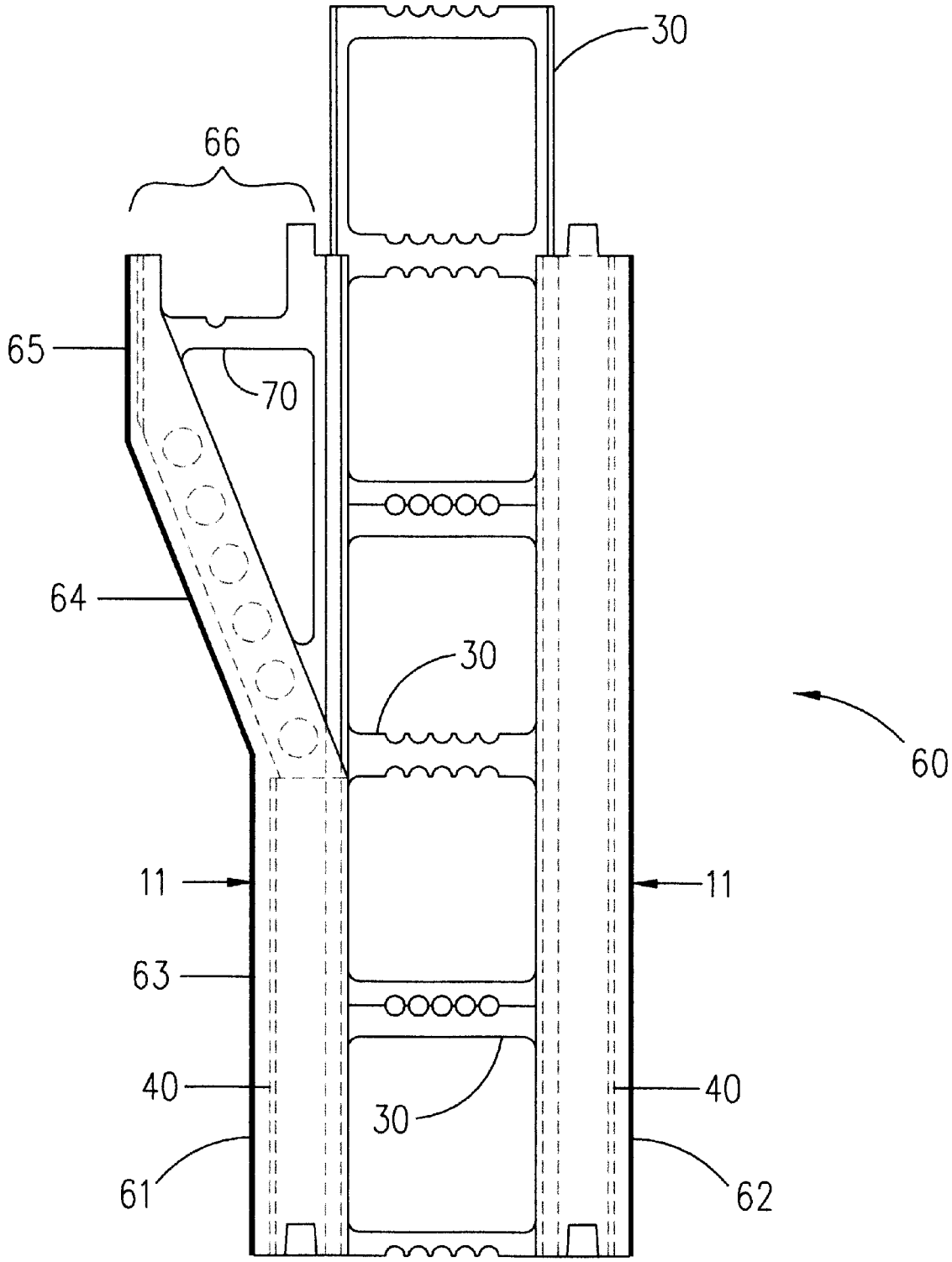
FIG. 7*d* is a cross-section view of the bearing ledge form of FIG. 7*a,* taken along line 7D—7D as shown in FIG. 7*c*.
Figure 8:
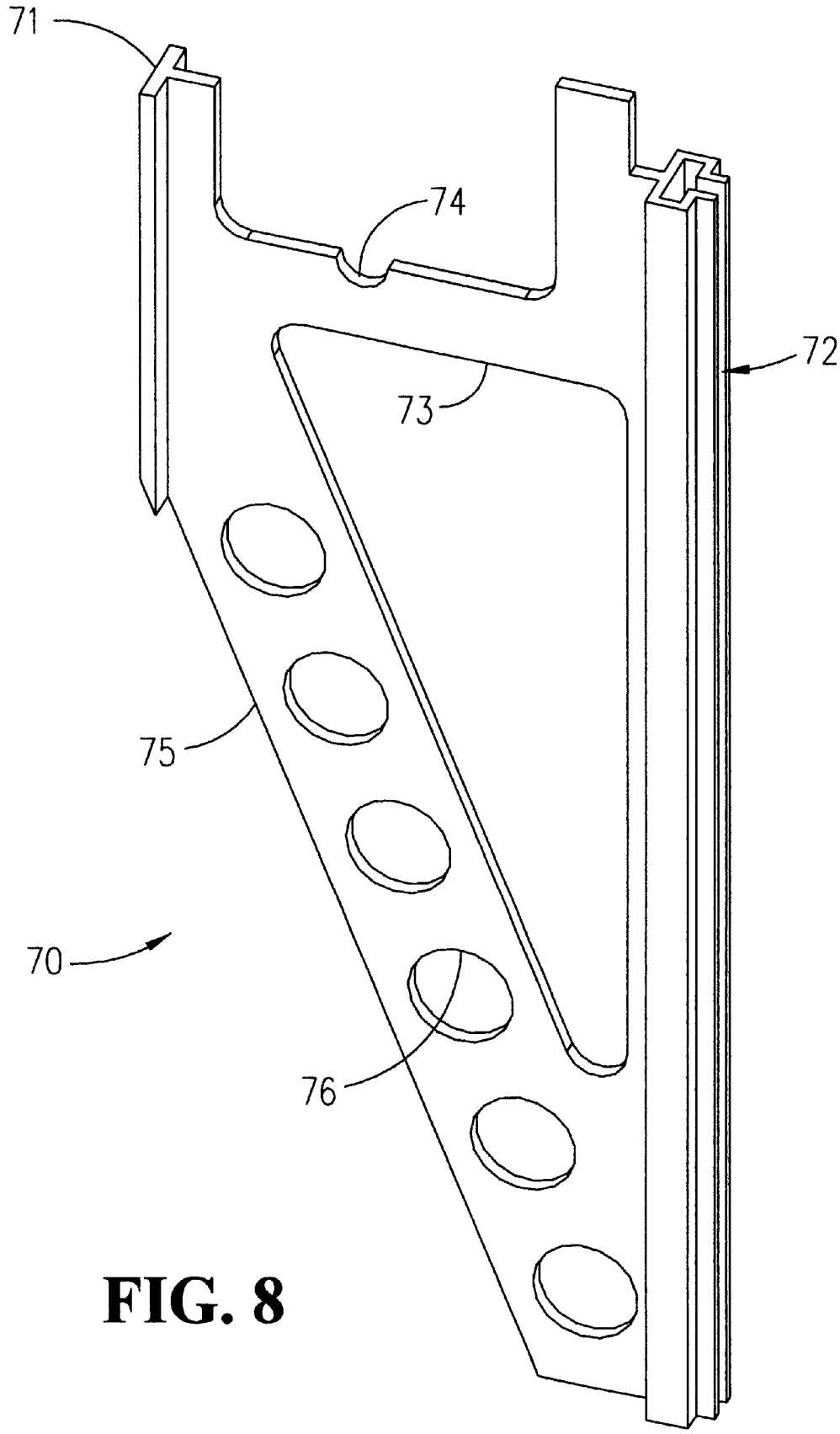
FIG. 8 is a perspective view of a bearing ledge form connector according to the present invention.
Figure 9A:
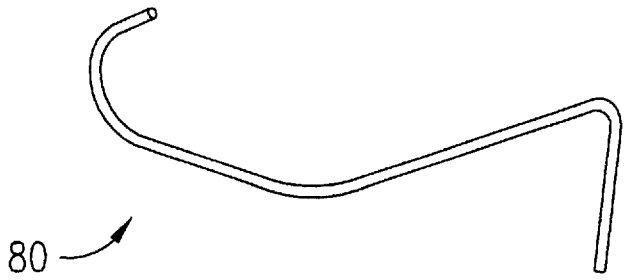
FIG. 9*a* is a perspective view of a clip for connecting wall reinforcing according to the present invention.
Figure 9B:
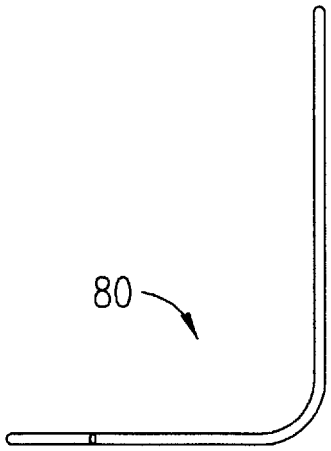
FIG. 9*b* is a top view of the clip of FIG. 9*a*.
Figure 9C:
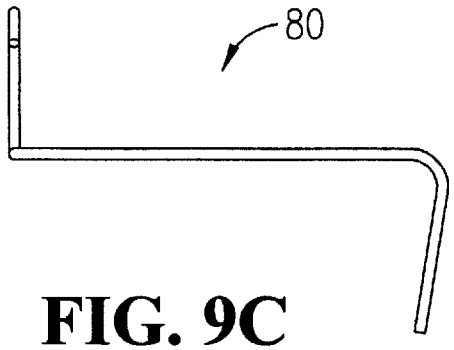
FIG. 9*c* is a side view of the clip of FIG. 9*a*.
Figure 9D:
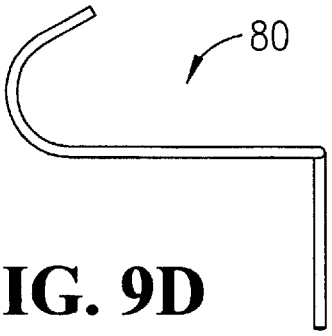
FIG. 9*d* is an end view of the clip of FIG. 9*a*.
Figure 10:
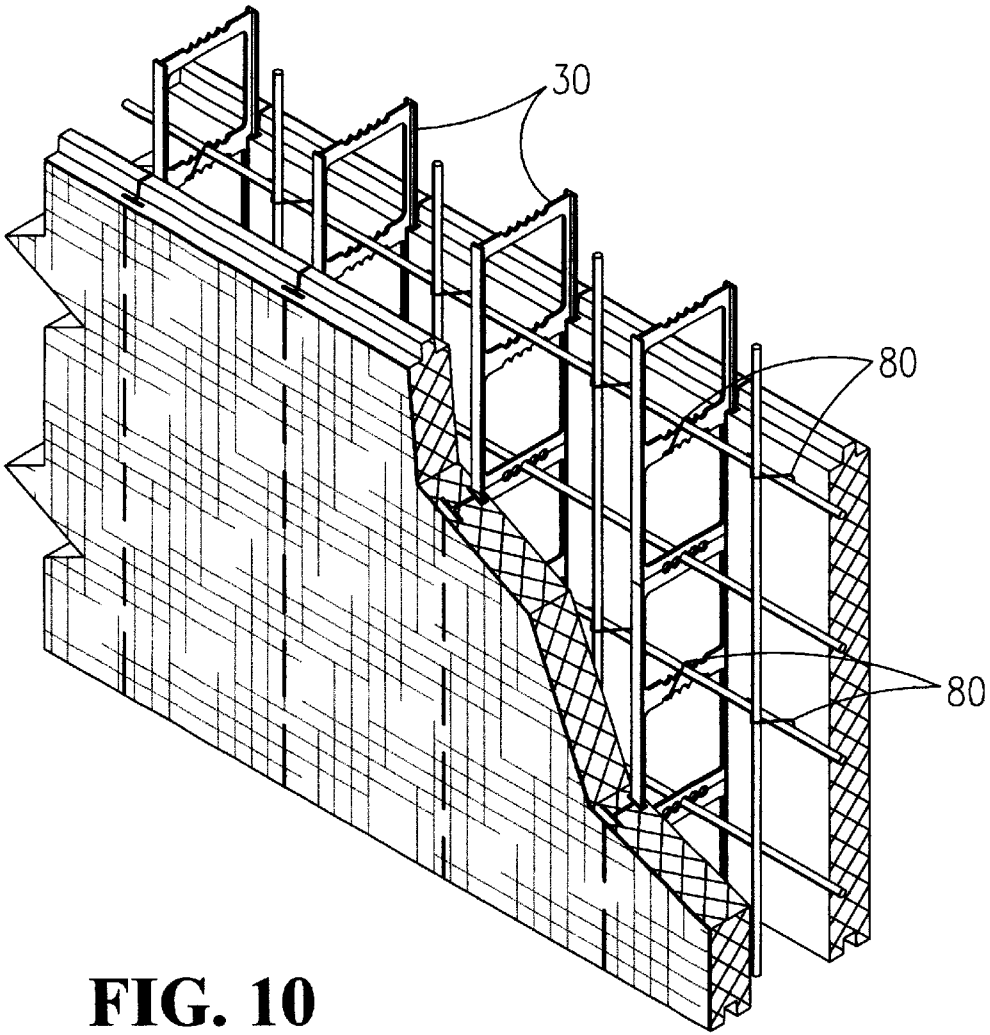
FIG. 10 is a perspective view of elements of the present invention illustrating interaction with wall reinforcing.

Another embodiment of the present invention a hinged form 90 comprises opposing panels 11, one of which is shown in FIG. 5, with at least one horizontal or vertical hinge member 100 embedded in each panel 11 (vertical hinge shown) extending the full length or full height of the panels 11. Each hinge 100 as shown in FIG. 6, has two flanges 101 oriented in an opposing and parallel relationship with a flexible hinge section 102 between. The flanges 101 are connected to the hinge section 102 by web members 103 which have multiple apertures 104 along their length to enhance the bond of the foam plastic from one side of the webs 103 to the other. Preferably the hinge 100 is extruded of HDPE or PP plastic, or other similar plastics which can provide a flexible hinge section 102 that may be bent without breaking. The hinged panels 90 can be bent to form corners, angles or tee walls. Multiple hinges 100 can be installed vertically and spaced apart along the length of the panels 11 to form curved walls.

Another embodiment of the present invention FIGS. 7*a* through 7*d,* discloses a bearing ledge form 60 for the support of brick, rock and other veneers comprising, panels 11 being molded in first panels 61 and second panels 62, the first panel 61 extends vertically in a first plane 63, then extends on a second plane 64 at an angle to the first plane 63 and then extends on a third plane 65 which is parallel and offset to the first plane 63 forming a haunch 66. The first panel 61 has embedded studs 30 that extend the full height of the first plane 63 and specialized bearing ledge connectors 70 (FIG. 8) embedded in the second plane 64 and the third plane 65. The spacing of the bearing ledge connectors 70 corresponds with the spacing of the studs 40. Having reference to FIG. 8 the bearing ledge connectors 70 have a partial height flange 71 and a full height groove 72 oriented in an opposing and parallel relationship that are connected by a horizontal member 73 and a web 75. The flange 71 begins at the top of the connector 70 and extends downward, the web 75 extends at an angle from the bottom of the flange 71 to the bottom of the groove 72 and has a plurality of apertures 76 along its length to enhance the bond of the foam plastic from one side of the web 75 to the other. The horizontal member 73 has a formation 74 to accommodate wall reinforcing. The second panel 62 has embedded studs 40 that extend the full height of the panel 11.

Figure 11:
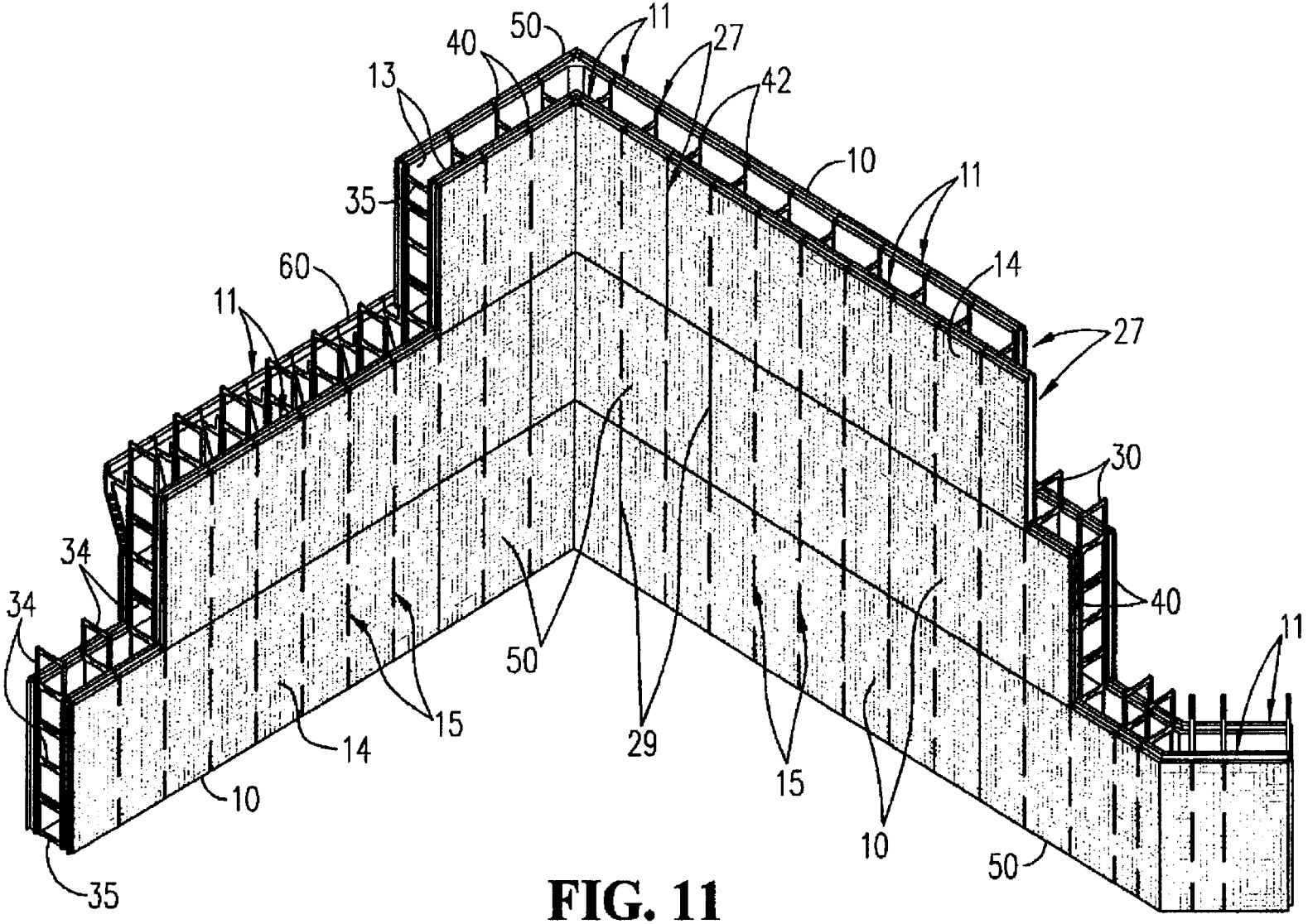
FIG. 11 is a perspective view of elements of the present invention interacting to form a system for the construction of concrete structures.

Multiple form panels 11 are stacked together to form walls as shown in FIG. 11, the panels 11 are placed in an opposing parallel spaced apart relationship with spreaders 30 that extend between the panels 11 and slide into the studs 40 thereby forming a cavity between the inside surface 13 of the panels 11, the cavity is then filled with fluid concrete. The panels 11 are placed end to end in rows and stacked vertically, the opposing panels 11 may be offset from each other so that the panel ends do not line up from one side of the wall to the other, the rows of panels 11 are staggered back and forth so the end joints 29 of adjacent panels do not line up vertically. As the panels 11 are stacked, spreaders 30 are installed, which slide into and engage the grooves 42 of the studs 40 embedded in the opposing panels 11. The spreaders 30 are "full height spreaders" 34, which are preferably half the height of the panels and "half height spreaders" 35, which are half the height of the full height spreaders 34. Half height spreaders 35 are installed at the bottom of the wall with full height spreaders 34 thereafter so at the top of each row of panels there are spreaders 30 which engage the studs 40 in the row of panels 11 below half their height and the engage the studs 40 in the row above the remaining half of their height. Half height spreaders 35 are installed at the top of the walls. Thus the present invention discloses a novel spreader 30 which overlaps the horizontal joints between rows of form panels 11, connecting the rows and forcing the wall to act as one unit from bottom to top, and also prevents the joints from shifting and bulging or causing blowouts. Therefore very little bracing is required to straighten the walls and stabilize them during concrete placement. The formations 33 in the top and bottom horizontal members 32 of the spreaders 30 compliment the formations 33 in the spreaders 30 above and below allowing horizontal wall reinforcing to be locked in place. There are multiple formations 33 in each horizontal member 32 so the reinforcing can be installed at any location that might be required by professional engineers. The full height studs 40 embedded in each form panel 11 allow them to be cut to any height and still provide a structurally sound unit, also door, window and other openings can be cut at any location without compromising the integrity of the wall.

Reinforcing clips 80 are provided, FIGS. 9*a* through 9*d*, as an additional means for securing wall reinforcing. The reinforcing clips 80 are preferably made of tempered wire which is deformed into the desired shape shown in the figures. Having reference to FIG. 10 the reinforcing clip 80 may be used to secure vertical wall reinforcing or any horizontal reinforcing located at intermediate horizontal members of spreaders 30. The ability of the spreaders 30 to lock reinforcing in place and the reinforcing clips 80 eliminate most manual tying of the wall reinforcing.

There are many advantages over the prior art disclosed in the present invention:

- the closed cell foam plastic is easily molded and has superior strength and adhesion, allowing the form panels to be cast in unlimited large sizes, and allows the facing to be adhered to the panels and the studs to be embedded and bonded within the panels creating stronger form units;
- the facing adds substantial strength to the panels during material handling, construction and concrete placement, provides a substrate for finish materials, also provides a UV resistant surface on the panels and is marked for visually locating embedded studs and chase ways;
- full height studs provide a continuous means for attaching finish materials and engaging spreaders and add substantial strength to the forms;
- the open configuration of the spreaders allows the concrete to flow naturally through the wall during placement, resulting in easier placement of the concrete and a much stronger wall.
- slide-in spreaders allow compact shipment of the forms and provide a means of quickly and easily erecting the forms at the job site;
- formations in the spreaders allow wall reinforcing to be locked in any preferred location;
- the ability of the spreaders to overlap the horizontal joints between rows of panels interconnects the rows strengthening the wall and forcing it to act as one unit from bottom to top;
- embedded chase ways provide a means of easily installing electrical wiring;
- reinforcing clips provide an additional means of securing wall reinforcing eliminating most manual tying of the reinforcing;
- hinged forms and corner forms allow corners of unlimited angles and tee walls to be formed quickly and easily with little bracing;
- bearing ledge forms provide support for brick, rock and other veneers and are useful for many other applications.

The stronger forms, larger form sizes and the configuration of the spreaders allow structures to be erected quickly with little bracing and allow the concrete to be placed easily with minimal danger of bulging or blowouts.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. In a system for constructing insulated concrete structures, a hinged form comprising:

- panels molded from a closed cell foam plastic, having inside and outside surfaces, top, bottom and end edges, said panels placed horizontally in an opposing and parallel, spaced-apart relationship;
- at least one horizontal or vertical hinge member embedded in at least one of the opposing panels, said hinge member having a first flange and a second flange oriented in an opposing and parallel relationship with a flexible hinge section between the flanges, flanges being connected to hinge section by web members, web members having a plurality of apertures along their length;
- at least two vertical studs embedded in each panel, said studs spaced longitudinally and parallel from each other;
- a plurality of spreaders at each stud location, extending between opposing panels and engaging the studs in opposing panels thereby creating a form with a cavity between the inside surfaces of the panels.

2. In a system for constructing insulated concrete structures, a bearing ledge form comprising:

first and second panels molded from a closed cell foam plastic, having inside and outside surfaces, top, bottom and end edges, said panels placed in an opposing and parallel, spaced-apart relationship, first panel extending vertically in a first plane, then extending on a second plane at an angle to first plane and then extending on a third plane parallel and offset to first plane, thus forming a haunch used as a bearing ledge;

at least two vertical studs embedded in first panel extending the height of first plane, said studs spaced longitudinally and parallel from each other;

at least two bearing ledge connectors embedded in first panel, located vertically above embedded studs, said bearing ledge connectors having a partial height flange and a full height groove oriented in an opposing and parallel relation, connected by at least one horizontal member and a web, said flange beginning at the top of the connector and extending downwards, web extending at an angle from the bottom of the flange to the bottom of the groove, and having a plurality of apertures along its length, horizontal member having formations to accommodate wall reinforcing;

at least two vertical studs embedded in second panel extending the full height of the panel, said studs spaced longitudinally and parallel from each other;

a plurality of spreaders at each stud location, extending between opposing panels and engaging the studs and bearing ledge connectors in opposing panels thereby creating a form with a cavity between the inside surfaces of the panels.

3. A system for constructing insulated concrete structures comprising:

multiple opposing form panels being placed end to end in horizontal rows and stacked vertically, panels may be staggered from each other in such a manner that ends of opposing panels are offset and end joints between adjacent rows of stacked panels do not line up vertically;

at least two vertical studs embedded in each panel extending the full height of the panels;

a plurality of spreaders at each stud location, the spreaders being "full height spreaders," substantially less in height than the vertical height of the panels, and "half height spreader," half the height of the full height spreaders, spreaders being stacked vertically, starting with a half height spreader with full height spreaders thereafter, such that at the top of each row of panels there is a full height spreader that engages the studs in the row below half its height and engages the studs in the row above the remaining half of its height.

4. The system for constructing insulated concrete structures as claimed in claim 3 further comprising:

an interlocking means, a tongue extending from and parallel to the top edge of each panel, and a complementary groove recessed into and parallel to the bottom edge of each panel, the embedded studs extending through the groove in each panel and the tongue of each panel having slots that correspond with the spacing of the studs, such that when forms are stacked the studs will engage the slots in the tongue of the row below, aligning studs of adjacent panels vertically.

5. The system for constructing insulated concrete structures as claimed in claim 3 wherein the end interface of panels comprises:

a stud halfway into, and protruding halfway from, the end edge of a first panel, and a complimentary slot in the end edge of a second panel, such that when the panels are placed end to end the panels interlock and spreaders may be installed to connect the opposing pairs of panels.

* * * * *